US008008569B2

(12) United States Patent
Iwase

(10) Patent No.: US 8,008,569 B2
(45) Date of Patent: Aug. 30, 2011

(54) MUSICAL SOUND GENERATING DEVICE AND STORAGE MEDIUM STORING MUSICAL SOUND GENERATION PROCESSING PROGRAM

(75) Inventor: Hiroshi Iwase, Akishima (JP)

(73) Assignee: Casio Computer Co., Ltd., Tokyo (JP)

( * ) Notice: Subject to any disclaimer, the term of this patent is extended or adjusted under 35 U.S.C. 154(b) by 274 days.

(21) Appl. No.: 12/330,705

(22) Filed: Dec. 9, 2008

(65) Prior Publication Data

US 2009/0151543 A1 Jun. 18, 2009

(30) Foreign Application Priority Data

Dec. 14, 2007 (JP) ..... 2007-323824

(51) Int. Cl.
*G10H 1/00* (2006.01)

(52) U.S. Cl. ..... 84/622; 84/659; 84/604

(58) Field of Classification Search ..... 84/604–607, 84/622–625, 659–661
See application file for complete search history.

(56) References Cited

U.S. PATENT DOCUMENTS 4,649,783 A * 3/1987 Strong et al. ..... 84/606
4,898,059 A * 2/1990 Iizuka ..... 84/601
4,922,794 A * 5/1990 Shibukawa ..... 84/601
5,086,475 A * 2/1992 Kutaragi et al. ..... 704/265
5,345,035 A 9/1994 Yamada
5,446,237 A * 8/1995 Abe et al. ..... 84/617
5,563,359 A 10/1996 Okamura
5,604,324 A * 2/1997 Kubota et al. ..... 84/622
5,689,080 A * 11/1997 Gulick ..... 84/604
5,714,703 A * 2/1998 Wachi et al. ..... 84/603
5,717,154 A * 2/1998 Gulick ..... 84/604
5,742,695 A * 4/1998 Suggs ..... 381/104
5,753,841 A * 5/1998 Hewitt ..... 84/604
5,763,801 A * 6/1998 Gulick ..... 84/604
5,809,342 A * 9/1998 Gulick ..... 710/64
5,850,050 A * 12/1998 Isozaki et al. ..... 84/622
5,918,302 A * 6/1999 Rinn ..... 84/604
5,920,843 A * 7/1999 Fay ..... 704/503
6,064,743 A * 5/2000 Suggs ..... 381/104

(Continued)

FOREIGN PATENT DOCUMENTS

EP 0 827 133 A1 3/1998

(Continued)

OTHER PUBLICATIONS

Japanese Office Action dated Jan. 12, 2010 and English translation thereof issued in a counterpart Japanese Application No. 2007-323824.

(Continued)

*Primary Examiner* — David S. Warren
(74) *Attorney, Agent, or Firm* — Holtz, Holtz, Goodman & Chick, PC

(57) ABSTRACT

Upon activation by a power-on operation, a CPU transfers part of waveform data items of predetermined tone colors from a waveform data storage to a waveform RAM, and after this, transfers data items including the remaining waveform data to be transferred. Thereby, a musical sound generating device assigns the transferred waveform data items to make it playable when the transfer of the part of the waveform data has been completed, and changes the assignment of the waveform data to make it playable in an ordinary state when the transfer of the remaining waveform data has been terminated.

2 Claims, 5 Drawing Sheets

U.S. PATENT DOCUMENTS

| | | | | |
|---|---|---|---|---|
| 6,138,224 | A * | 10/2000 | Lisle | 711/206 |
| 6,195,736 | B1 * | 2/2001 | Lisle | 711/206 |
| RE37,367 | E * | 9/2001 | Wachi et al. | 84/603 |
| 6,576,827 | B2 * | 6/2003 | Tamura | 84/622 |
| 6,762,358 | B2 | 7/2004 | Iguchi et al. | |
| 6,956,160 | B2 * | 10/2005 | Mukojima | 84/602 |
| 7,038,119 | B2 * | 5/2006 | Petef | 84/604 |
| 7,039,477 | B1 * | 5/2006 | Kamiya et al. | 700/94 |
| 7,274,967 | B2 * | 9/2007 | Tico et al. | 700/94 |
| 7,332,668 | B2 * | 2/2008 | Hsieh | 84/622 |
| 2001/0027715 | A1 | 10/2001 | Tsutsumi | |
| 2002/0139238 | A1 | 10/2002 | Mukaino | |
| 2002/0178898 | A1 * | 12/2002 | Hagiwara et al. | 84/664 |
| 2002/0189430 | A1 * | 12/2002 | Mukojima | 84/615 |
| 2003/0172799 | A1 * | 9/2003 | Sakurai et al. | 84/622 |
| 2004/0112203 | A1 * | 6/2004 | Ueki et al. | 84/613 |
| 2004/0159217 | A1 * | 8/2004 | Murakii | 84/622 |
| 2004/0231497 | A1 * | 11/2004 | Hsieh | 84/622 |
| 2005/0011341 | A1 * | 1/2005 | Petef | 84/622 |
| 2005/0211070 | A1 * | 9/2005 | Tamura | 84/603 |
| 2005/0257666 | A1 * | 11/2005 | Sakurada | 84/609 |
| 2006/0201311 | A1 * | 9/2006 | Hasegawa | 84/613 |
| 2007/0261540 | A1 * | 11/2007 | Gremo et al. | 84/743 |
| 2008/0028919 | A1 * | 2/2008 | Ueki et al. | 84/613 |
| 2009/0151543 | A1 * | 6/2009 | Iwase | 84/604 |

FOREIGN PATENT DOCUMENTS

| | | | |
|---|---|---|---|
| JP | 11-288285 | A | 10/1999 |
| JP | 2000-181491 | A | 6/2000 |
| JP | 2003-044285 | A | 2/2003 |
| JP | 2003-208181 | A | 7/2003 |
| JP | 2007-271827 | A | 10/2007 |

OTHER PUBLICATIONS

Extended European Search Report dated Apr. 8, 2009 (8 pages), issued in counterpart European Application Serial No. 08021451.3.

* cited by examiner

MUSICAL SOUND GENERATING DEVICE AND STORAGE MEDIUM STORING MUSICAL SOUND GENERATION PROCESSING PROGRAM

CROSS-REFERENCE TO RELATED APPLICATIONS

This application is based upon and claims the benefit of priority from prior Japanese Patent Application No. 2007-323824, filed Dec. 14, 2007, the entire contents of which are incorporated herein by reference.

BACKGROUND OF THE INVENTION

1. Field of the Invention

The present invention relates to a musical sound generating device for generating musical sounds with pitches instructed through operations on musical performance operators by using waveform data items indicating waveforms of the musical sounds.

2. Description of the Related Art

Most of the musical sound generating devices, which generate musical sounds through digital processing in accordance with operations on a musical performance operators such as a keyboard, are provided with waveform data items indicating waveforms of the musical sounds. The musical sound generating device generates waveform data of the musical sounds to be sounded by using the waveform data items. The waveform data items are data items each indicating changes in amplitude values for each predetermined time interval.

The tone colors have different musical sound waveforms. Many tone colors vary in musical sound waveform in accordance with a pitch or a velocity in operation on a musical performance operator (including a strength of breath-out). Accordingly, many musical sound generating devices which have a plurality of waveform data items for each tone color have been commercialized. Such a musical sound generating device may generate a musical sound with a higher tone quality. The conventional musical sound generating device disclosed in Jpn. Pat. Appln. KOKAI Publication No. 2007-271827 assigns different waveform data items of the same tone color to different sound ranges.

It is usual for a data amount of the waveform data items to be extremely large. To increase the number of producible musical sounds, there is a need to store the waveform data items in a device accessible at high speed. Therefore, usually, a RAM is adopted as the device. Most of the adopted RAMs are volatile from the aspect of costs. Accordingly, some of the musical sound generating devices store the waveform data items in a non-volatile memory such as a ROM or a flash memory, or an external storage device such as a hard disk drive (hereinafter referred to as "non-volatile device"), and transfer the waveform data items from the non-volatile device to a volatile memory such as a RAM in activation of the device caused by applying power.

The data to be transferred from the non-volatile devices to the volatile-devices with the starting time as a trigger is usually not only waveform data item of one tone color. It is usual for the musical sound generating device to transfer data (data group) of an amount as a whole capable of immediately achieving a minimal function as the musical sound generating device. While the data varies depending on each function mounted on the musical sound generating device, most of the musical sound generating devices transfer music data for automatic musical performance or data of a kind related to musical performance of music score data, etc., in addition to waveform data items of tone colors.

For these reasons, it takes a certain time to transfer data. The conventional musical sound generating device is configured receive instructions by the operations of a user after completion of the transfer. Therefore, there is a problem that a relatively long time is required for the musical sound generating device to become a state capable of generating musical sounds, namely to become a state in which a user is permitted to play the musical sound generating device after activation of the device.

The conventional musical sound generating device disclosed in Jpn. Pat. Appln. KOKAI Publication No. 2000-181491 transfers necessary waveform data items from the non-volatile device to the volatile memory by selecting the music data showing musical performance content of a music. Transferring only the necessary waveform data items achieves transfer at high speed.

It is an object of the present invention to provide a musical sound generating device which quickly becomes a state in which a user is permitted to play the device after activation of the device.

BRIEF SUMMARY OF THE INVENTION

According to one aspect of the invention, there is provided a musical sound generating device for sounding musical sounds with pitches instructed through operations on musical performance operators by using waveform data items indicating waveforms of the musical sounds. The device comprises: first storage means for storing various data items for use in operations of the musical sound generating device, the various data items including waveform data items each corresponding to one of tone colors of the musical sounds; second storage means accessible faster than the first storage means; data transfer means for transferring a data group which is to be transferred in activation of the musical sound generating device, among the various data items stored in the first storage means, to the second storage means, the data transfer means preferentially transferring waveform data items which correspond to predetermined tone colors, among waveform data items of the data group; and limiting means for limiting operations of the musical sound generating device in accordance with a transfer situation of the data group by the data transfer means.

According to another aspect of the invention, there is provided a computer-readable storage medium storing computer-executable program applied to a musical sound generating device for sounding musical sounds with pitches instructed through operations on musical performance operators by using waveform data items indicating waveforms of the musical sounds. The program comprises: data transfer means for transferring a data group which is to be transferred in activation of the musical sound generating device, among various data items stored in a first storage means including waveform data items each corresponding to one of tone colors of the musical sounds for use in operations of the musical sound generating device, to the second storage means accessible faster than the first storage means, the data transfer means preferentially transferring waveform data items which correspond to predetermined tone colors, among waveform data items of the data group; and limiting means for limiting operations of the musical sound generating device in accordance with a transfer situation of the data group by the data transfer means.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Hereinafter, embodiments of the invention will be described in detail with reference to the drawings.

Figure 1:
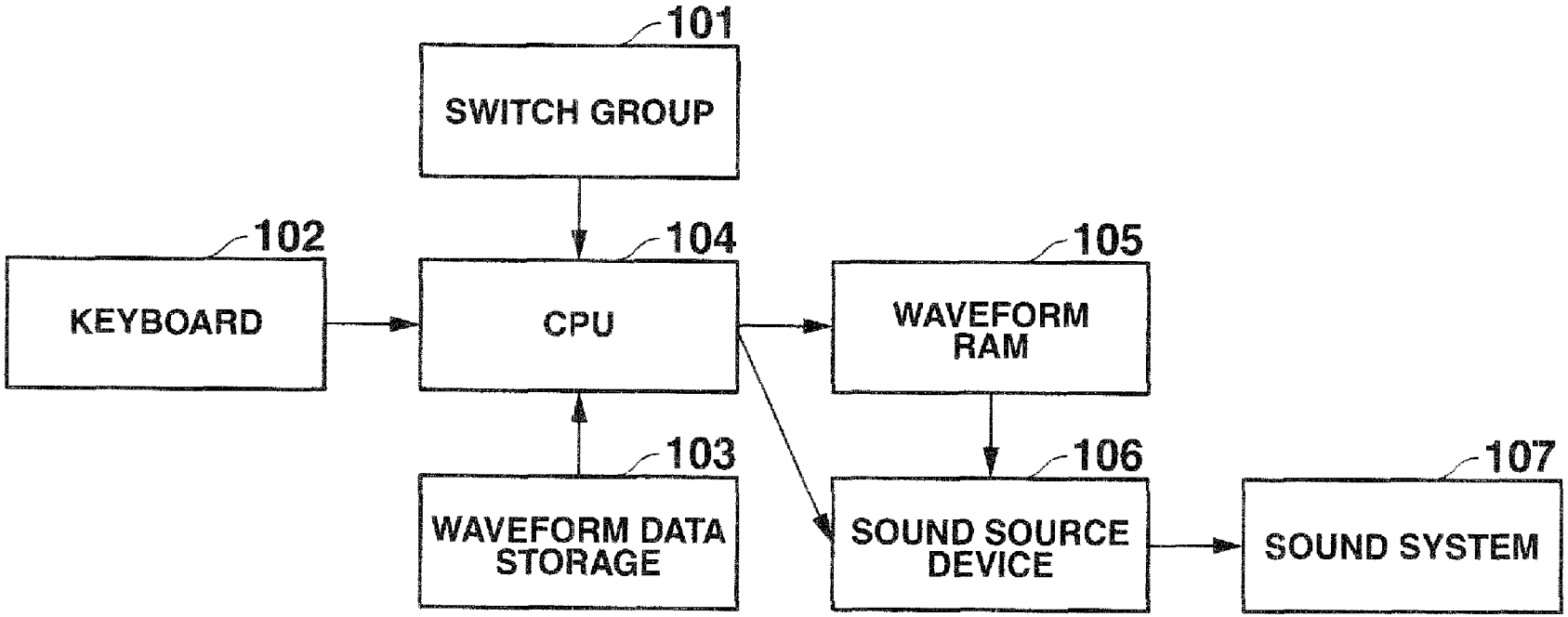
FIG. 1 is a view depicting a configuration of a musical sound generating device of an embodiment of the invention.

FIG. 1 shows a view illustrating a configuration of a musical sound generating device of the embodiment of the invention.

The musical sound generating device comprises, as shown in FIG. 1, a switch group 101 including various switches and damper pedals; a keyboard 102 as musical performance operators; a non-volatile waveform data storage (hereinafter referred to as "storage") 103 storing waveform data items of tone colors, music data, music score data, and the like; a CPU 104 for controlling the whole of the musical sound generating device; a volatile waveform RAM 105 accessible faster than the storage 103; a sound source device 106 for generating waveform data items of sounds to be sounded; and a sound system 107 for producing musical sounds by means of the waveform data items generated from the sound source device 106.

While FIG. 1 does not show particularly, the musical sound generating device also includes a display control device for displaying an image on a display device, a MIDI interface for transmitting and receiving MIDI data, and so on.

The CPU 104 controls the whole of the musical sound generating device by executing a program stored in a ROM mounted on itself or in the storage 103. The switch group 101 is provided with a detection circuit for detecting states of various switches. The detection circuit detects the states of the various switches every fixed time period or in response to a request from the CPU 104, and reports the detection result to the CPU 104. The CPU 104 compares the detection result with a detection result reported just before, then specifies a key of which the state has changed and its changed content, and reflects the specified content to control.

The keyboard 102 is also provided with a detection circuit for detecting states of keys in the similar manner as that of the switch group 101. The keyboard 102 is compatible with a touch response which varies a sound volume in accordance with a velocity in pressing the key. Sensors, for example, two sensors are provided for detecting the velocity of the pressing of the key. The detection circuit reports the detection results of the sensors to the CPU 104. The CPU 104 compares the detection results with detection results reported just before, then specifies the changed content, and controls generation of musical sounds. If the changed content is caused by pressing the key, the CPU 104 calculates a key pressing time length spent from a time of starting the key pressing to a time of finishing the key pressing, and then calculates the velocity at the key pressing. The calculated velocity is reflected to the generation of the musical sound. Thereby, a touch response function is achieved.

The touch response function is turned on (validated) or turned off (invalidated) by operating setting switches provided for the switch group 101. Thereby, if the touch response function has not been turned on (validated), the CPU 104 does not calculate the key pressing time length, etc.

The switches provided for the switch group 101 includes tone color switches for specifying the tone colors of the musical sounds to be sounded through the operation on the keyboard 102, a selection switch for selecting a music to be an object of automatic musical performance, a start/stop switch for instructions of starting or stopping the automatic musical performance, etc. Here, for the sake of convenience, it is assumed that there are a plurality of tone color switches and that the tone colors are specified by operating tone color switches.

The sound source device 106 uses waveform data items stored in the waveform RAM 105 to generate waveform data items of the musical sound to be sounded through time division processing. The sounding control of the musical sound by the CPU 104 is performed by generating and outputting a command to be output to the sound source device 106. The command is implemented, for example, using MIDI data.

The MIDI data sets a tone color for each channel. Content of an operation on the damper pedal is reported to the sound source device 106 through MIDI data indicating a control change message. The channel which makes the message valid is a cannel to be assigned to the musical sound to be sounded through operations on the keyboard 102.

The waveform data item to be generated for each musical sound from the sound source device 106 is represented by an amplitude value in one sampling period. The waveform data items to be stored in the waveform RAM 105 are, for example, amplitude values of the number of samplings needed to generate amplitude values from the starting of sounding the musical sound until silencing the musical sound. Hereinafter, for avoiding confusion, the waveform data item to be generated from the sound source device 106 is referred to as "amplitude value". The amplitude value to be output from the sound source device 106 to the sound system 107 is a cumulative value of the amplitude values of the musical sounds to be sounded.

In the time division processing, the amplitude values are generated (calculated) for each musical sound at time intervals according to a number of simultaneously-producible musical sounds and a sampling period of the waveform data item. Thereby, for example, if the sampling period is equivalent to 25 μsec (sampling frequency is equivalent to 40 KHz), and the number of simultaneously-producible musical sounds is equivalent to 100, the amplitude values are calculated at not more than at time intervals of 250 nsec per one musical sound. The waveform RAM 105 is accessible at high speed to enable calculation of such amplitude values. The sound source device 106 performs the calculation of the amplitude value accompanied by an access to the waveform RAM 102 in accordance with the command to be input from the CPU 104.

The sound system 107 is provided, for example, with a digital to analog converter for converting the amplitude value into an audio signal of analog, an amplifier for amplifying the audio signal, and a loud-speaker for sounding the musical sound through the amplified audio signal. Thereby, the musical sound is sounded by outputting the amplitude value from the sound source device 106 to the sound system 107.

The musical sound generating device having the aforementioned configuration is an electronic musical instrument with the keyboard 102. The musical sound generating device to which the invention is applicable may be applicable to the musical instrument which is not provided with musical performance operators such as the keyboard 102.

In the configuration shown in FIG. 1, the invention may be widely applicable to a computer including configuration elements equivalent to the storage 103, the CPU 104, the waveform RAM 105 and sound source device 106. The program to be executed by the CPU 104 so that the invention is applied to the musical sound generating device may be distributed by storing in a storage medium such as an optical disk and a flash memory, and may be distributed via a communication network such as a LAN and the Internet.

Thus, the program may be accessible from the device which is distributed via the communication network. For functioning as the musical sound generating device by the program, the activation of the musical sound generating device is equivalent to the activation of the program.

Figure 2A:
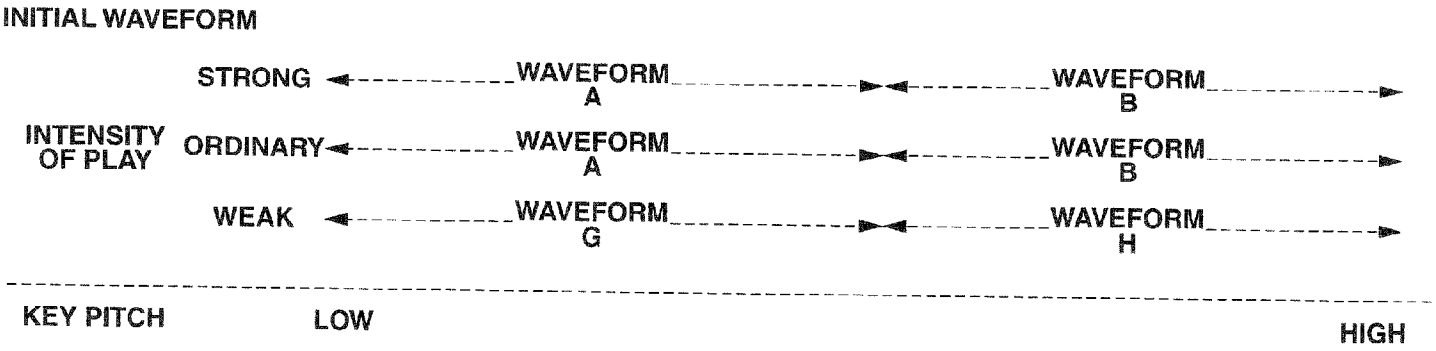
FIGS. 2A and 2B are views for explaining changes in assignment according to transfer situations of waveform data items.
Figure 2B:
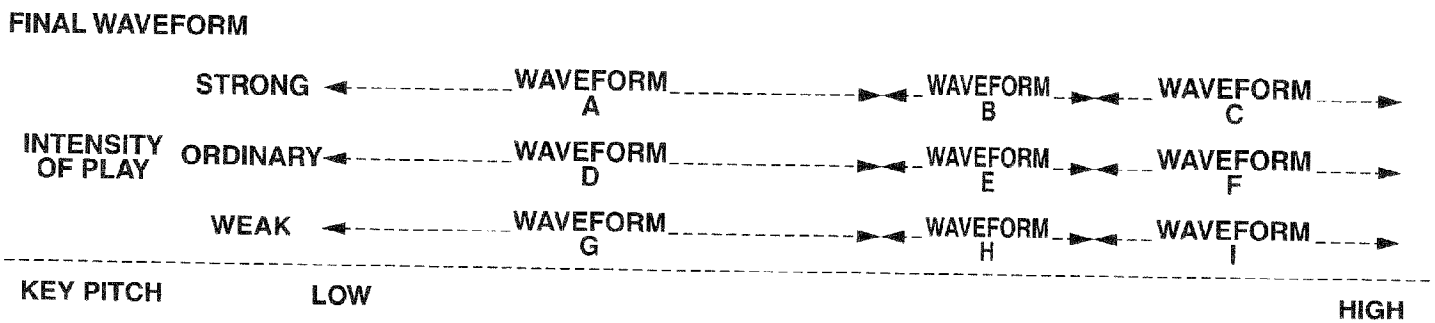

FIGS. 2A and 2B are views for explaining the change in assignment in accordance with the transfer situation of the waveform data items.

In this embodiment, Upon the activation (by a power-on operation) of the musical sound generating device, the CPU 104 firstly transfers the waveform data items of predetermined tone colors from the storage 103 to the waveform RAM 105. Another data (data group) to be transferred is transferred next. Thereby, at a time point when the transfer of the waveform has completed, the musical sound generating device shifts to a state in which a user is permitted to play, and thus a user can quickly start to play the musical sound generating device. The tone color is selected, for example, to a tone of the piano.

To enable the user to start playing the musical sound generating device more quickly, in this embodiment, the CPU 104 shifts to the state in which a user is permitted to play the musical sound generating device at a time point when the transfer of the minimum necessary waveform data items have been completed. FIG. 2A shows assignment of the waveform data items at the completion of transfer of the minimum necessary waveform data items (in sifting into a state in which a user is permitted to play the musical sound generating device). FIG. 2B shows assignment of assignment of the waveform data items at the end of transfer of the entire waveform data items (in ordinary circumstances). In FIGS. 2A and 2B, wave forms A, B, C, D, E, F, G, H and I display different waveforms of a same tone color, respectively.

In ordinary circumstances, as shown in FIG. 2B, a pitch (tone interval) capable of being generated through an operation to the keyboard 102 is divided into three sound ranges, by separating the velocity of key pressing (intensity of playing) into three stages of "strong", "medium" and "weak", and then, the musical sound generating device uses the waveform data items in different nine states in accordance with the pressed keys (pitches) and their velocities of pressing.

When the transfer of the waveform data items has not been completed, as shown in FIG. 2A, the CPU 104 shifts into the state in which a user is permitted to play the musical sound generating device at the time points when the transfer of waveforms A, B, G, H have been completed. At those time points, the sound range is divided into two, in a low sound range, the waveform A is assigned to the key pressing by a high velocity (strong intensity) and by a medium velocity, and the waveform G is assigned to the key pressing by a low (weak) velocity. In a high sound range, the waveform B is assigned to the key pressing by a high velocity (strong intensity) and by a medium velocity, and the waveform H is assigned to the key pressing by a low (weak) velocity.

In this way, in the embodiment, when transferring a data group which is to be transferred in activation of the musical sound generating device, among various data items stored in the storage 103, the CPU 104 preferentially transfers waveform data items of predetermined tone colors, among waveform data items of the data group, and limits operations of the musical sound generating device in accordance with the transfer situation.

By the operational limitation, it is possible to allow the musical sound generating device to be used while Imitating its operation according to a transfer situation at that time. Therefore, in comparison with a case of waiting for completion of the transfer, it is possible to allow the musical sound generating device to be played within a short time from the transfer start (activation).

In this embodiment, as shown in FIGS. 2A and 2B, in accordance with the transfer situation of the waveform data items, the change in assignment of the waveform data items is dymanically executed in two stages; however, the change in assignment may be dymanically performed in many further stages.

For instance, shifting to the state in which a user is permitted to play the musical sound generating device may be performed after the completion of transfer of one waveform data item, and changing in assignment after that may be performed for every completion of transfer of more than one piece of the waveform data item. Since differences among the waveform data items are caused by tone colors, it is preferable for the change in assignment to be determined in consideration of the tone colors of the waveform data items to be preferentially transferred. The tone color may not be fixed, but may be selected from the tone colors which are frequently specified by a user or from the tone colors which are specified just before, in accordance with situations.

In this way, when the assignment of the waveform data items is dymanically changed in accordance with situations, the musical sound generating device becomes able to be played by the completion of the transfer of a few more pieces of waveform data items. When limiting operations of the musical sound generating device such as reducing the number of simultaneously-producible musical sounds, based on whether or not the transfer of the data group has been completed as the transfer situation, the transfer becomes able to be efficiently carried out. In any case, the musical sound generating device becomes able to be played within a shorter time period.

The transfer of the waveform data items is to be carried out when the sound source 106 does not access the waveform RAM 105. The access is performed with high frequency as the number of musical sounds simultaneously produced becomes larger. Therefore, in this embodiment, to complete the transfer of the waveform data items within shorter time period, the number of simultaneously-producible musical sounds is limited at least during transfer of the waveform data items. The limitation is carried out by suppressing the number of simultaneously-producible musical sounds up to the extent of a half of the usual number. The number is referred to as a "limited number of the musical sounds $\alpha$" herein.

Hereinafter, the operations will be described in detail with reference to the flowchart of each processing shown in FIGS. 3 to 6. Each of those processing is achieved by the CPU 104 through carrying out the program stored in the ROM mounted on the CPU 104 itself, or stored in the storage 103.

Figure 3:
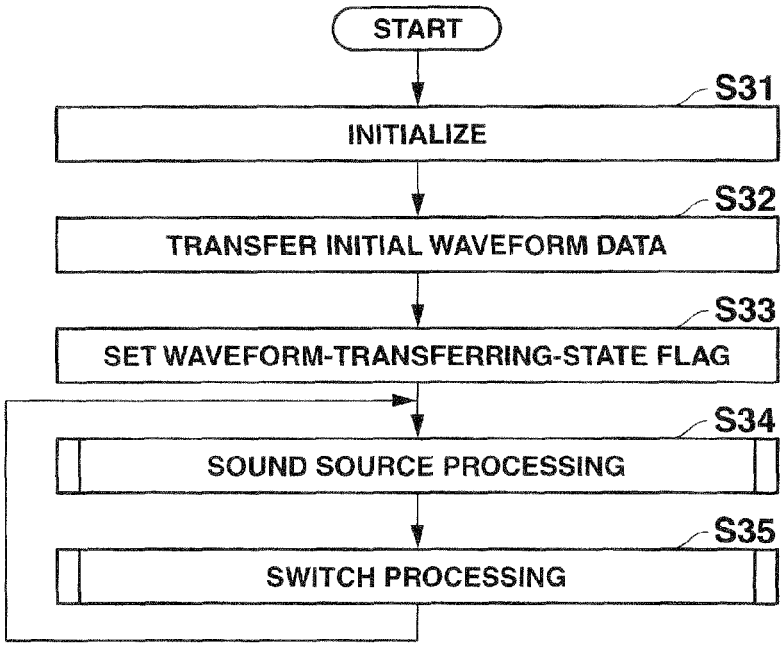
FIG. 3 is a flowchart of a whole of processing.

FIG. 3 is the flowchart of whole processing. At first the whole processing will be described in detail by referring to FIG. 3. The whole processing is the processing to be carried out upon the power-on (activation) of the musical sound generating device.

The CPU 104 firstly performs initialization in Step S31. The initialization initializes the CPU 104 itself, the keyboard 102, the sound source device 106, etc., into predetermined states, respectively. After this, the CPU 104 shifts to Step S32 to transfer the minimum necessary waveform data items of the predetermined tone colors. After completion of the transfer, the CPU 104 sets an waveform transferring-state flag that is a variable in Step S33 then shifts to Step S34. The shift brings the musical sound generating device into a state in which a user is permitted to play the musical sound generating device.

As mentioned above, the transfer of the minimum necessary waveform data items enables assignment of the waveform data items as shown in FIG. 2A. The setting of the waveform transferring-state flag is carried out, for example, by assigning "1". The clearing of the under-transfer flag is carried out, for example, by assigning "0". The under-transfer flag is referred to, for example, in waveform transfer processing that is timer interrupt processing to be carried out by an interrupt signal generated at predetermined time intervals.

The CPU 104 performs sound source processing for generating musical sounds in accordance with the operations on the keyboard 102 in Step S34. Switch processing for responding to the operations by the user to each switch is performed in the following Step S35. After this, although the flowchart does not depict particularly, the CPU 104 executes another processing such as display, data transmission, reception, and automatic play, and then returns to the foregoing Step S34. Thereby, the state which is adaptive to the operations by the user is maintained.

Figure 4:
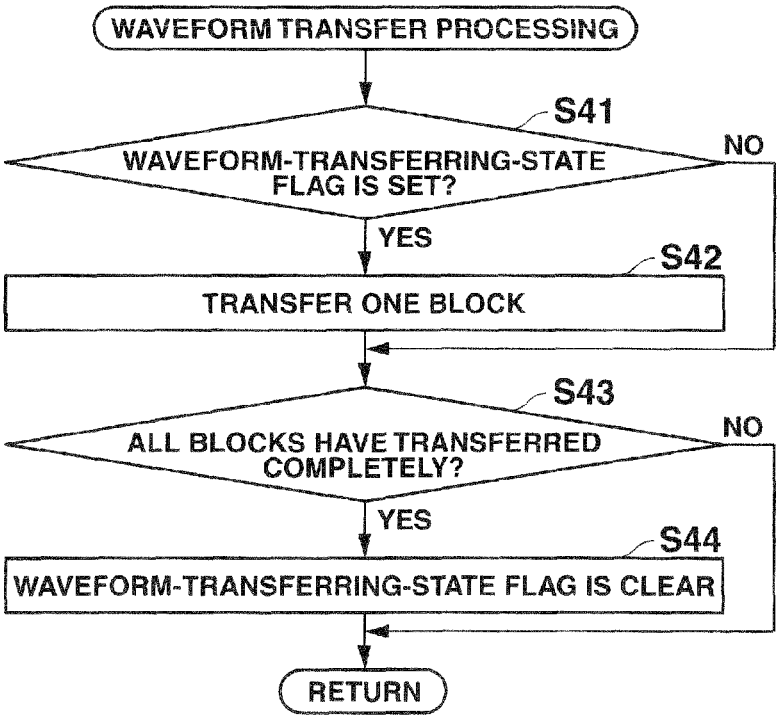
FIG. 4 is a flowchart of waveform transfer processing.

FIG. 4 shows a flowchart of the aforementioned waveform transfer processing. The transfer processing will be described in detail with reference to FIG. 4. The transfer processing is timer interrupt processing to be performed in order to transfer the data to be transferred from the storage 103 to the waveform RAM 105. A block in FIG. 4 indicates a unit (data amount) in performing data transfer.

The CPU 104 firstly determines whether or not the waveform transferring-state flag has been set in Step S41. If the flag has been set, the determination results in "YES", the CPU 104 reads the waveform data items of one block to be transferred from the storage 103. After performing the transfer to store the waveform data items in the waveform RAM 105 in Step S42, the CPU 104 shifts to Step S43. Otherwise, namely, if the flag has not been set, the determination results in "NO", and then, the CPU 104 carries out the Step S43.

In Step S42 of the above, for example, it is determined whether or not the transfer of the waveform data items of the predetermined tone colors has been completed, and the assignment of the waveform data items corresponding to the determination result is also performed. Thereby, if it is determined that the transfer has been completed, the CPU 104 changes the assignment of the waveform data items from a state shown in FIG. 2A to another state shown in FIG. 2B.

It is determined whether or not the transfer of all the blocks has been completed in Step S43. If the transfer of all waveform data items to the waveform RAM 105 has been completed, the determination is given as "YES" in Step S43, and after clearing the waveform transferring-state flag, the waveform transfer processing is terminated in Step S44. If the transfer of all waveform data items to the waveform RAM 105 has not been completed, determination is given as "NO", here, the waveform transfer processing is terminated.

Figure 5:
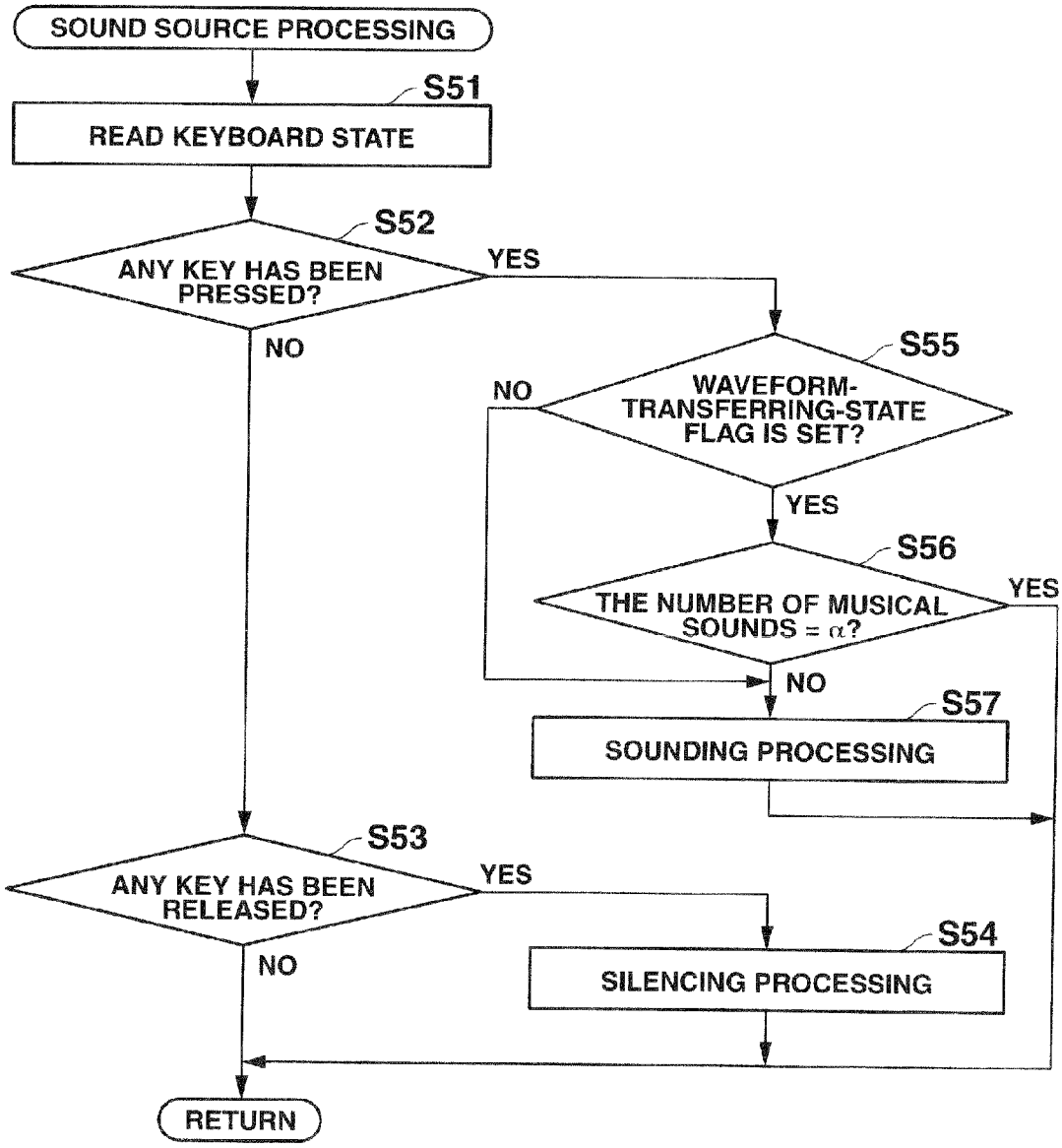
FIG. 5 is a flowchart of sound source processing.

FIG. 5 is a flowchart of the sound source processing to be carried out as Step S34 in the whole processing shown in FIG. 3. The sound source processing will be described in detail by referring to FIG. 5.

The CPU 104 firstly reads (inputs) the detection result of the state of each key from the keyboard 102 to compare with the previously read detection result, and then, specifies any key of which the state has been changed and its changed content, etc., in Step S51. In the following Step S52, it is determined whether any key has been pressed or not. If the key from which the change in state by key pressing has been specified, the CPU 104 determines as "YES" to shift the sound source processing into Step S55. Otherwise, the determination is given as "NO" to shift the sound source processing into Step S53.

In Step S53, the CPU 104 determines whether any key has been released or not. If any key from which the change in state by its key release has been specified, the determination is given as "YES", and after performing silencing processing for the musical sound under-sounding corresponding to the specified key in Step S54, the sound source processing is terminated. Otherwise, the determination is given as "NO", here; the sound source processing is terminated.

The silencing processing generates a command to be sent to the sound source device 106 and send the command thereto. As is widely known, the damper pedal is an operator capable of extending, even after the key has been released, the sounding of the musical sound to be specified by the timing at which the operation for the damper pedal has been conducted. Accordingly, the silencing processing is carried out in consideration of the operation for the damper pedal.

In Step S55, which has been shifted in a way by which the determination in Step S52 is given "YES", it is determined whether or not the waveform transferring-state flag has been set. If the flag has been set, the determination is given as "YES" and the CPU 104 shifts to Step S56. Otherwise, the CPU 104 determines "NO" to shift to Step S57.

The CPU 104 determines whether or not the number of musical sounds currently being produced is equal to the number a that is the number of limited musical sounds in Step S56. If the two numbers coincide with one another, the determination is given as "YES", then, the sound source processing is terminated. Otherwise, the determination is given as "NO", the CPU 104 shifts to Step S57, and after executing sounding processing to start sounding of the musical sound with a pitch caused by a newly pressed key, the CPU 104 terminates the sound source processing. If a touch response function has been turned on, the sounding processing is performed in consideration of the velocity of detection (calculation).

In this way, according to the embodiment, by neglecting the key pressing that poses a result to exceed the musical-sound limited number a during the transfer of waveform data items, the number of simultaneously-producible musical sounds is suppressed to not larger than the musical-sound limited number $\alpha$. Such limitation, may be set by silencing the musical sounds which have already sounded of the number of musical sounds to be started the sounding by new key pressing.

Figure 6:
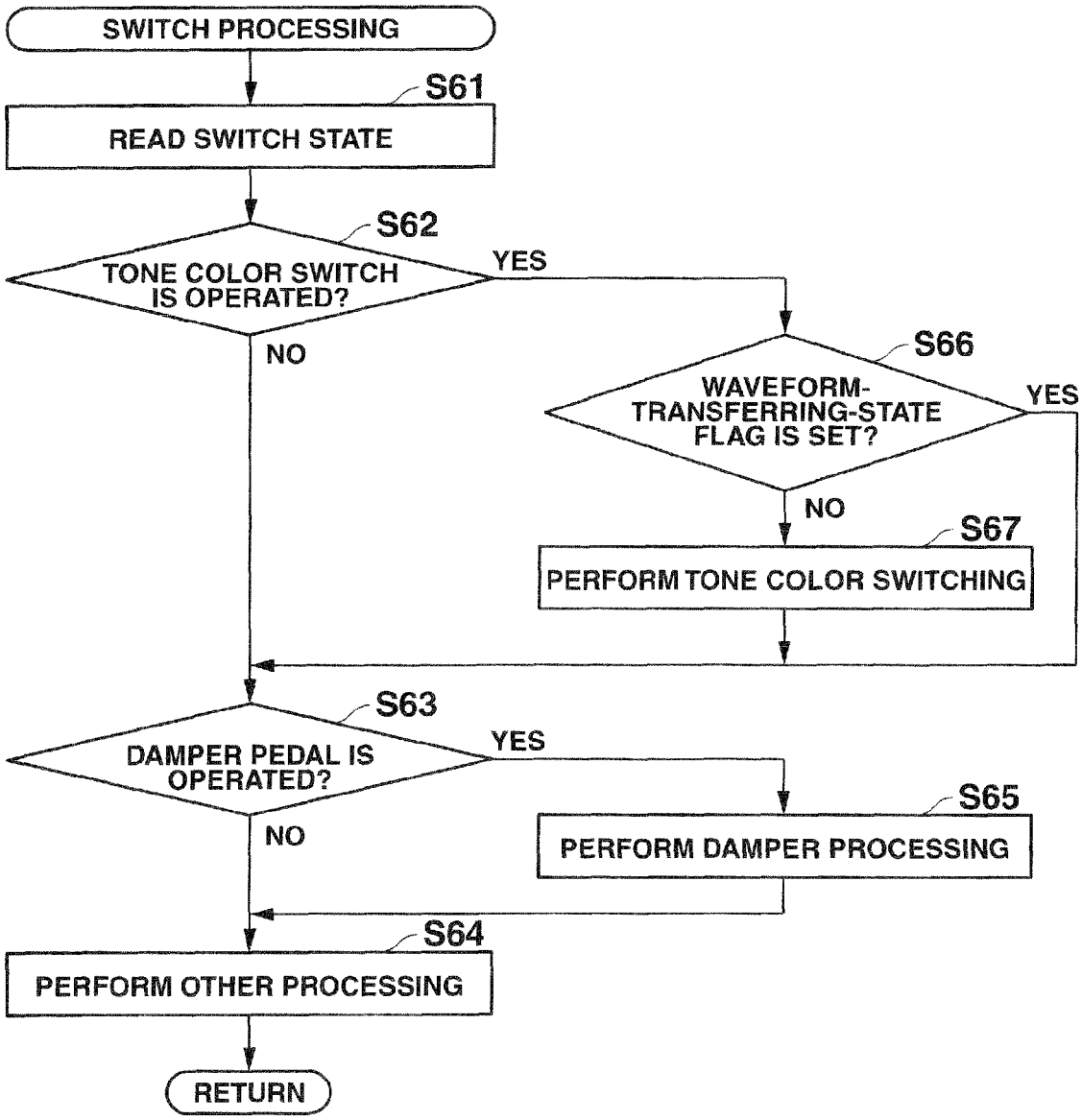
FIG. 6 is a flowchart of switch processing.

FIG. 6 is a flowchart of the switch processing to be executed in Step S35 in the whole processing shown in FIG. 3. Finally, the switch processing will be described in detail by referring to FIG. 6.

The CPU 104 firstly reads (inputs) a detection result of a state of each switch from the switch group 101 to specify a switch of which the state is changed and a changed content, etc., by comparing the read detection result with a detection result read just before in Step S61. It is determined whether any tone color switch has been turned on or not in the following Step S62. If the user operates the switch, it is determined as "YES" and the switch processing is shifted to Step S66. Otherwise, it is determined as "NO" and the switch processing is shifted to Step S63.

In Step S63, it is determined whether or not the damper pedal is operated (turned on or off). If the operation has not been done, it is determined as "NO", and after executing other processing in Step S64 so as to respond to the operation for other switches, a series of processing is terminated. Otherwise, it is determined as "YES", after executing the damper processing for responding to the operation conducted to the damper pedal, the switch processing shifts to the Step 64.

Meanwhile, in Step S66, the CPU 104 determines whether the waveform transferring-state flag has been set or not. If the flag has been set, the determination is given as "YES", the switch processing shifts to Step S63. Otherwise, the determination is given as "NO", after executing tone color switch processing for switching the tone colors in accordance with the operated tone color switch, the switch processing shifts to Step S63.

In this way, while the embodiment has neglected a switching instruction for the tone color performed during transfer of the waveform data items, given priority to the transfer of the waveform data items in execution, and then, quickly terminated the transfer, it may determine whether or not a new specification is effective depending on whether the waveform data items of the tone color have been transferred or not. It also may immediately transfer the waveform data items if the data has not been transferred by giving priority to the tone color specification.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A musical sound generating device equipped with first storage means for storing various data items for use in operations of the musical sound generating device, the various data items including waveform data items each corresponding to one of tone colors of musical sounds, and second storage means accessible faster than the first storage means, the device sounding musical sounds with pitches instructed through operations on musical performance operators by using waveform data items indicating waveforms of the musical sounds stored in the second storage means, the device comprising:

a tone color switch for switching tone colors of musical sounds;

data transfer means for transferring a data group which is to be transferred in activation of the musical sound generating device, among the various data items stored in the first storage means, to the second storage means, the data transfer means preferentially transferring waveform data items which correspond to predetermined tone colors, among waveform data items of the data group; and limiting means for limiting operations of the musical sound generating device, including invalidating an operation of the tone color switch, during the transfer of the data group by the data transfer means.

2. A non-transitory computer-readable storage medium having a program stored thereon for controlling a musical sound generating device equipped with first storage means for storing various data items for use in operations of the musical sound generating device, the various data items including waveform data items each corresponding to one of tone colors of musical sounds, second storage means accessible faster than the first storage means, and a tone color switch for switching tone colors of musical sounds, the device sounding musical sounds with pitches instructed through operations on musical performance operators by using waveform data items indicating waveforms of the musical sounds stored in the second storage means, the program controlling the musical sound generating device to function as elements comprising:

data transfer means for transferring a data group which is to be transferred in activation of the musical sound generating device, among the various data items stored in the first storage means, to the second storage means, the data transfer means preferentially transferring waveform data items which correspond to predetermined tone colors, among waveform data items of the data group; and limiting means for limiting operations of the musical sound generating device, including invalidating an operation of the tone color switch, during the transfer of the data group by the data transfer means.

* * * * *